US008789925B1

(12) United States Patent
Thompson

(10) Patent No.: US 8,789,925 B1
(45) Date of Patent: Jul. 29, 2014

(54) METHOD AND APPARATUS FOR PRINTING OF MAGNETIC INKS

(71) Applicant: Xerox Corporation, Norwalk, CT (US)

(72) Inventor: Michael D. Thompson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 9 days.

(21) Appl. No.: 13/757,343

(22) Filed: Feb. 1, 2013

(51) Int. Cl.
*B41J 2/14* (2006.01)
*B41J 2/16* (2006.01)

(52) U.S. Cl.
USPC ..... 347/53

(58) Field of Classification Search
CPC ..... B41J 2002/041; B41J 2/10; B41J 2/06; B41J 2/14; B41J 2/035
See application file for complete search history.

(56) References Cited

U.S. PATENT DOCUMENTS 5,382,963 A * 1/1995 Pond et al. ..... 346/25
5,516,445 A * 5/1996 Sasaki et al. ..... 252/62.56
5,685,952 A 11/1997 Owen
5,745,128 A 4/1998 Lam et al.
6,086,198 A 7/2000 Shields et al.
6,221,138 B1 * 4/2001 Kenny ..... 106/31.32
6,234,608 B1 5/2001 Genovese et al.
6,254,220 B1 7/2001 Silverbrook
7,047,883 B2 5/2006 Raksha et al.
7,332,101 B2 2/2008 Singh et al.
7,517,578 B2 4/2009 Raksha et al.
7,604,855 B2 10/2009 Raksha et al.
7,934,451 B2 5/2011 Raksha et al.
2004/0210289 A1 10/2004 Wang et al.
2009/0185992 A1 7/2009 Conan et al.
2010/0221510 A1 9/2010 Odell et al.

OTHER PUBLICATIONS

Odenbach, Stefan et al. Magnetoviscous Effects in Ferrofluids. Electronic Paper [online]. LNP 594, pp. 185-201, 2002 [retrieved on Apr. 15, 2014]. Retrieved from the Internet: <URL: http://pages.csam.montclair.edu/~yecko/ferro/papers/LNP594_0denbach_Ferrofluids/OdenbachThurm_Visco.pdf>.*

Magnetorheological Fluid (Wikipedia) [online] Dec. 3, 2013. [retrieved on Apr. 15, 2014]. Retrieved from the Internet: <URL: http://en.wikipedia.org/wiki/Magnetorheological_fluid>.*

Properties of Paper (Pulp & Paper Resources & Information Site) [online]. [retrieved on Apr. 15, 2014-04]. Retrieved from the Internet<URL: http://www.paperonweb.com/paperpro.htm>.*

Michael Murray; Emergent Viscous Phenomena in Ferrofluids; Essay; Dec. 19, 2008; 12 Pages.

* cited by examiner

*Primary Examiner* — Lisa M Solomon
(74) *Attorney, Agent, or Firm* — Maginot, Moore & Beck, LLP

(57) ABSTRACT

A method of printing with a magnetic ink includes ejecting a plurality of magnetic ink drops onto a print medium in a print zone and applying a magnetic field to the ink drops on the print medium. The magnetic field increases a viscosity of the magnetic ink drops and reduces or eliminates absorption of the magnetic ink into a porous print medium such as paper.

14 Claims, 4 Drawing Sheets

METHOD AND APPARATUS FOR PRINTING OF MAGNETIC INKS

TECHNICAL FIELD

This disclosure relates generally to methods for forming ink images on a substrate and, more particularly, to using a printer in a process for printing images with a magnetic ink on paper or another porous substrate.

BACKGROUND

Inkjet imaging devices are used to print a wide range of documents using various types and colors of ink. Some printed documents are read by both humans and by other machines. For example, a check includes printed text that is both human readable and readable by automated check processing equipment. Check processing machines use Magnetic Ink Character Recognition (MICR) to identify printed characters in a check, such as routing and account numbers, quickly and accurately. The magnetic ink includes a suspension of magnetic particles, such as iron oxide, which are detectable using a magnetic field. The use of MICR printing is widespread and enables automated processing of checks and other documents even when the printed magnetic ink characters are visually obscured by stamps or other overprinting. Automated check processing machines perform high-speed character recognition using printed magnetic ink characters to identify account and routing numbers. While check processing is one application of magnetic ink printing, magnetic inks can be incorporated in a wide range of printed documents and can be used in conjunction with non-magnetic inks as well.

One challenge in using magnetic inks with inkjet printers relates to the propensity of the magnetic inks to absorb or "bleed" into porous print media such as uncoated paper. A typical magnetic ink includes a liquid solvent holding a suspension of microscopic magnetic particles. The liquid solvent and magnetic particles are ejected in the form of drops onto the paper where the solvent evaporates, leaving the magnetic particles. During the drying process, however, the solvent and magnetic particles absorb into the fiber of the paper instead of remaining concentrated near the surface of the paper.

FIG. 5 depicts a prior art inkjet 504 in the process of ejecting magnetic ink drops 508 onto a porous print medium 514. The magnetic ink drops 508 initially form a character 512 on the surface of the print medium 514 as the print medium 514 moves past the inkjet 504 in the process direction P. Over time, however, the print medium 514 absorbs some of the solvent and magnetic particles. A portion of the ink 518 from an earlier printed character 516 bleeds into the porous print medium 514, and an even greater portion 524 of a printed character 520 that was printed prior to the character 516 bleeds into the porous print medium 514. In addition to being visually undesirable, the absorbed ink spreads over a wider area of the print medium 514 and printed characters or other markings are distorted due to the absorption of the magnetic ink. The distortion may reduce the ability of automated scanning equipment to read information encoded with the magnetic ink accurately.

To reduce or eliminate bleeding, some magnetic ink printers use specially treated print media, such as wax coated papers, which reduce the porosity of the print medium to reduce or eliminate the absorption of the magnetic ink. Using coated papers, however, adds to the expense of printing documents and reduces the versatility of a magnetic ink printing system. Consequently, improvements to magnetic ink printers that improve the readability of images printed with magnetic ink would be beneficial.

SUMMARY

In one embodiment, a method for printing magnetic ink has been developed. The method includes moving a print medium through a print zone in a process direction, ejecting a plurality of drops of a magnetic ink from a plurality of inkjets in the print zone onto a surface of the print medium, moving the print medium past a magnetic field generator located in the process direction from the plurality of inkjets in the print zone, and applying a magnetic field with an orientation that is substantially parallel to the process direction to the plurality of drops of the magnetic ink on the surface of the print medium with the magnetic field generator to increase a viscosity of the magnetic ink on the print medium in a direction that is perpendicular to the process direction extending into the print medium.

In another embodiment, a printing apparatus that is configured to print magnetic inks has been developed. The printing apparatus includes a media path configured to move a print medium through a print zone in a in a process direction, a plurality of inkjets in the print zone configured to eject a plurality of drops of a magnetic ink onto a surface of the print medium, and a magnetic field generator located in the process direction from the plurality of inkjets in print zone and configured to apply a magnetic field with an orientation that is substantially parallel to the process direction to the plurality of drops of the magnetic ink on the surface of the print medium to increase a viscosity of the magnetic ink in a direction that is perpendicular to the process direction extending into the print medium.

DETAILED DESCRIPTION

Figure 1:
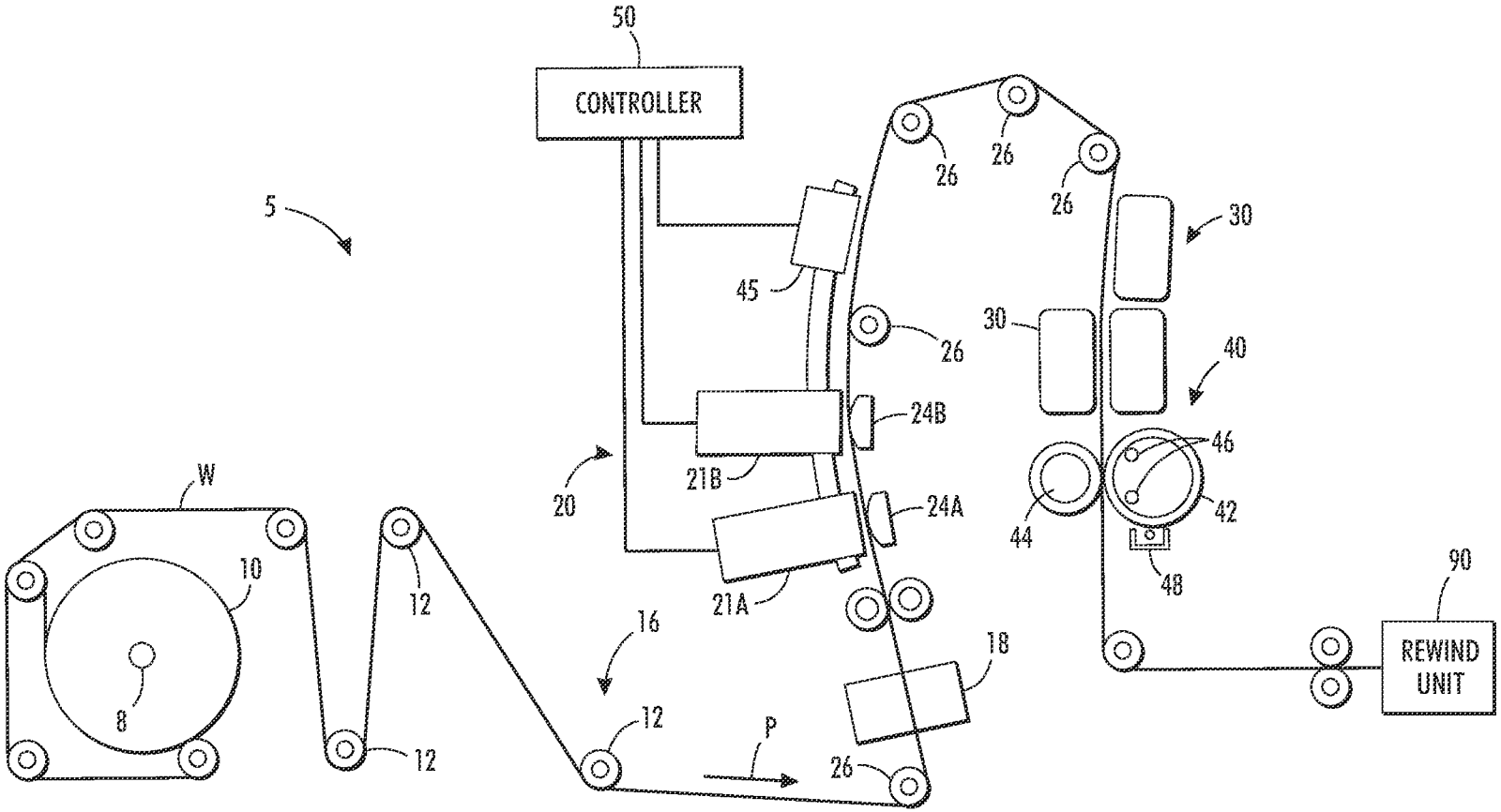
FIG. 1 is a schematic depiction of an inkjet printer.

For a general understanding of the environment for the system and method disclosed herein as well as the details for the system and method, reference is made to the drawings. In the drawings, like reference numerals have been used throughout to designate like elements.

As used herein the term "printer" refers to any device that is configured to print images on an image receiving surface. Common examples of printers include, but are not limited to, xerographic and inkjet printers. Various printer embodiments use one or more marking agents, such as ink or toner, to form printed images in various patterns. An image receiving surface refers to any surface that receives a marking agent, such as an imaging drum, imaging belt, or various print media including paper. The term "substrate" refers to a print medium, such as paper, that holds printed images. In some embodiments, the printer is a digital printer. Digital printers enable an operator to design and modify image data to alter the image printed on the substrate easily using, for example, commercially available image editing software.

A continuous feed or "web" printer produces images on a continuous web print substrate such paper. In some configurations, continuous feed printers receive image substrate material from large, heavy rolls of paper that move through the printer continuously instead of as individually cut sheets. The paper rolls can typically be provided at a lower cost per printed page than pre-cut sheets. Each such roll provides an elongated supply of paper printing substrate in a defined width. Fan-fold or computer form web substrates may be used in some printers having feeders that engage sprocket holes in the edges of the substrate. After formation of the images on the media web, one or more cutting devices separate the web into individual sheets of various sizes. Some embodiments use continuous feed printing systems to print a large number of images in a timely and cost efficient manner.

As used herein, the term "magnetic ink" refers to an ink that includes a suspension of magnetic particles in a liquid or phase-change medium. Some magnetic inks include a suspension of particles, such as iron oxide, in an aqueous or organic based solvent. Another type of magnetic ink is a phase-change magnetic ink, such as an ultraviolet (UV) curable ink. The phase-change magnetic ink is either solid or gelatinous at room temperature and includes magnetic particles that are distributed through the phase-change ink. When heated to a predetermined melting temperature, the phase change ink melts into a liquid state with the magnetic particles suspended in the liquid ink. An inkjet printer ejects liquid drops of the phase-change magnetic ink onto an image receiving surface where the phase-change ink is exposed to a UV light source and solidifies on the surface of a print medium.

As used herein, the term "fix" as applied to an ink image refers to a process of permanently marking a print medium with an ink. When the ink includes a solvent, the fixing process includes drying the ink to evaporate the solvent and leave pigments and magnetic particles permanently in place on the print medium. When the ink is a phase-change ink, the fixing process includes spreading the liquid ink drops on the print medium and forming a durable bond between the printed ink drops and the print medium.

FIG. 1 is a simplified schematic view of the direct-to-sheet, continuous-media, phase-change inkjet printer 5, that is configured to print images using both magnetic and non-magnetic inks. A media supply and handling system is configured to supply a long (i.e., substantially continuous) web of media 14 of "substrate" (paper, plastic, or other printable material) from a media source, such as spool of media 10 mounted on a web roller 8. One common type of substrate is uncoated paper. The uncoated paper includes a matrix of cellulose fibers. The uncoated paper is porous and can absorb liquids, including liquid inks, which are printed on the paper. The printer 5 includes a feed roller 8, media conditioner 16, printing station or print zone 20, and rewind unit 90. The media source 10 has a width that substantially covers the width of the rollers 12 and 26 over which the media travels through the printer. The rewind unit 90 is configured to wind the web onto a takeup roller for removal from the printer and subsequent processing.

The media can be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media can be transported along the path in cut sheet form in which case the media supply and handling system can include any suitable device or structure that enables the transport of cut media sheets along an expected path through the imaging device. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media are transported through a print zone 20 that includes a series of printhead units 21A and 21B. Each printhead unit effectively extends across the width of the media and is able to place ink directly (i.e., without use of an intermediate or offset member) onto the moving media. Each of the printhead units 21A and 21B includes a plurality of printheads positioned in a staggered arrangement in the cross-process direction over the media web 14. As is generally familiar, each of the printheads can eject a single color of ink, one for each of the inks typically used in the printer 5.

Each of the printhead units in the printer 5 can use "phase-change ink," by which is meant that the ink is substantially solid at room temperature and substantially liquid when heated to a phase change ink melting temperature for jetting onto the image receiving surface. The phase change ink melting temperature can be any temperature that is capable of melting solid phase change ink into liquid or molten form. In one embodiment, the phase change ink melting temperature is approximately 70° C. to 140° C. In alternative embodiments, the ink utilized in the imaging device can comprise UV curable gel ink. Gel ink is typically heated before being ejected by the inkjets of the printhead. As used herein, liquid ink refers to melted solid ink, heated gel ink, or other known forms of ink, such as aqueous inks, ink emulsions, ink suspensions, ink solutions, or the like.

In the configuration illustrated in FIG. 1, the printhead unit 21A ejects a non-magnetic ink onto the media web 14 and the printhead unit 21B ejects a magnetic ink onto the media web 14. In another embodiment, a printer includes multiple printhead units with the same configuration as printhead unit 21A that are configured to eject different colors of non-magnetic ink for multi-color printing. In still another embodiment, a printer only prints magnetic ink instead of printing both the non-magnetic and magnetic inks. In the printer 5, the printhead unit 21A optionally ejects a different form of ink than the printhead unit 21B. That is to say, while the printhead unit 21B can eject a solvent based magnetic ink that carries magnetic particles, the printhead unit 21A can be configured to eject another form of ink, such as phase-change or aqueous inks, to form non-magnetic ink images on the media web 14. In the print zone 20, the media web 14 passes the printhead unit 21A in the process direction P to receive non-magnetic ink prior to passing the printhead unit 21B to receive the magnetic ink.

The controller 50 of the printer receives velocity data from encoders mounted proximate to rollers positioned on either side of the portion of the path opposite the printhead units 21A and 21B to compute the position of the web as the web moves past the printheads. The controller 50 uses these data to generate timing signals for actuating the inkjets in the printheads to enable the four colors to be ejected with a reliable degree of accuracy for registration of magnetic and non-magnetic ink patterns to form single or multi-color images on the media. The inkjets actuated by the firing signals correspond to image data processed by the controller 50. The image data can be transmitted to the printer, generated by a scanner (not shown) that is a component of the printer, or otherwise electronically or optically generated and delivered to the printer. In various alternative embodiments, the printer 5 includes a different number of printhead units and can print inks having a variety of different colors.

A backing member 24A and 24B is associated with each of printhead units 21A and 21B, respectively. The backing members 24A and 24B are typically in the form of a bar or roll, which is arranged substantially opposite the printhead on the back side of the media. Each backing member is used to position the media at a predetermined distance from the printhead opposite the backing member. Each backing member can be configured to emit thermal energy to heat the media to a predetermined temperature. In one practical embodiment, the backing member emits thermal energy in a range of about 40° C. to about 60° C. The backer members can be controlled individually or collectively. The pre-heater 18, the printheads, backing members 24 (if heated), as well as the surrounding air combine to maintain the media along the portion of the path opposite the print zone 20 in a predetermined temperature range of about 40° C. to 70° C.

As the partially-imaged media web 14 moves to receive inks of various colors from the printheads of the print zone 20, the printer 5 maintains the temperature of the media web 14 within a predetermined temperature range. The printheads in the printhead unit 21A eject a phase-change ink at a temperature that is typically significantly higher than the temperature of the media web 14. Consequently, the ink heats the media. Therefore, other temperature regulating devices can be employed to maintain the media temperature within a predetermined range. For example, the air temperature and air flow rate behind and in front of the media may also impact the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature. In an alternative printer embodiment, the MICR ink is a solvent-based liquid ink that dries on the surface of the media web 14 after passing the magnetic field generator 45. The solvent in the solvent-based ink dries through evaporation, and optional heaters located along the process path promote the evaporation of the solvent.

Following the print zone 20 along the media path, the media web 14 moves past a magnetic field generator 45. In one embodiment, the magnetic field generator 45 is an electromagnet that is operatively connected to the controller 50. The controller 50 selectively activates and deactivates the electromagnet 45, and also selects an intensity of the magnetic field that the electromagnet 45 generates. For example, the controller 50 activates the electromagnet 45 at the beginning of a print job that includes printing of magnetic ink, and deactivates the electromagnet 45 during maintenance operations in the printer 5 or when the printer 5 performs a print job that does not include printing with the magnetic ink. In another embodiment, the magnetic field generator 45 is a permanent magnet that is not directly operated by the controller 50. In either embodiment, the magnetic field generator produces a magnetic field having a field strength in a range of approximately 200 Gauss to 800 Gauss at the surface of the media web 14.

The magnetic field generator 45 is positioned on the same side of the media web 14 as the printhead units 21A and 21B. Thus, the magnetic field generator faces the printed side of the media web 14, and the magnetic field generator 45 aligns magnetic particles in the magnetic ink on the media web 14 in process direction P and attracts the image as a whole in direction 62. The strength of the magnetic field is insufficient to separate the magnetic particles from the ink or the image from the surface of media web 14, but the magnetic field increases the overall viscosity of the magnetic ink on the surface of the media web 14.

The magnetic field generator generates a magnetic field that is approximately parallel to the surface of the media web 14. As described in more detail below, magnetic particles in the magnetic ink drops align with the magnetic field and the viscosity of ink on the media web 14 increases due to exposure to the magnetic field. The magnetic field generator 45 is located at a sufficient distance in the process direction P from the magnetic printhead unit 21B to prevent the magnetic field from affecting magnetic ink within reservoirs and fluid channels in the printhead unit 21B or affect the flight of magnetic ink drops that are ejected by the printhead unit 21B.

During a printing operation, the magnetic ink includes properties of both a ferrofluid and a magnetorheological fluid. As is known in the art, both ferrofluids and magnetorheological fluids include a suspension of magnetic particles, such as iron particles, in a liquid medium. Ferromagnetic fluids typically have particles on the scale of several nanometers that are small enough to remain in suspension due to Brownian motion in the liquid. Magnetorheological fluids typically include larger particles with sizes on the order of one micron or above, which are usually too large to remain in suspension due to Brownian motion. In one embodiment, the magnetic particles in the ink are formed with sizes of between approximately 10 nm and 500 nm. The particles are small enough to avoid clogging inkjets in a printhead.

As part of the ferromagnetic properties of the ink, the magnetic field generator applies an attractive force to the magnetic ink, although the practical strength of the magnetic field is insufficient to pull the magnetic particles out of suspension in the ink. The magnetorheological properties of the ink enable the magnetic particles in the ink to align in chain-like arrangements along flux lines of the magnetic field from the magnetic field generator. The configuration of the magnetic particles produces an increase in the anisotropic viscosity of the magnetic ink. As used herein, the term "anisotropic viscosity" refers to a change in the viscosity that is affected by the direction of a magnetic field through the magnetic ink. For example, in the printer 5 the magnetic field from the magnetic field generator 45 generates magnetic field lines that extend in parallel to the process direction P. The anisotropic viscosity increases the viscosity of the ink in directions that are perpendicular to the magnetic field, while the ink has a lower viscosity in directions that are parallel to the magnetic field.

Figure 3:
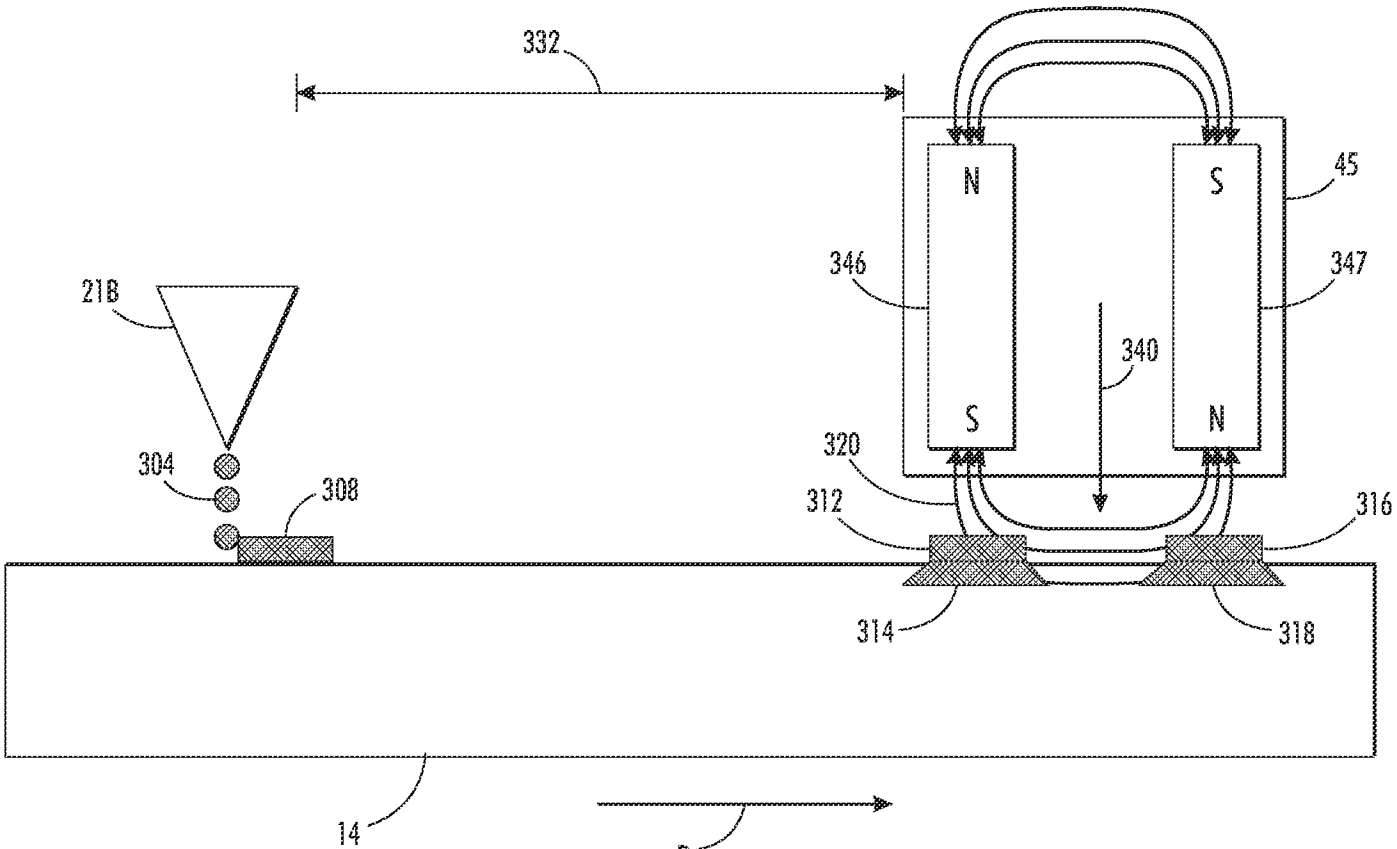
FIG. 3 is a diagram depicting magnetic ink printing onto a porous print medium with application of magnetic field to change the viscosity of the printed magnetic ink.

FIG. 3 depicts the magnetic field generator 45 and magnetic ink on the print medium 14 in more detail. In FIG. 3, the printhead unit 21B ejects ink drops 304 onto the surface of the media web 14 to form the magnetic ink image 308. The ink drops 304 are "in-flight" ink drops. As used herein, the term "in-flight" refers to ink drops ejected from the inkjets in the printhead unit 21B prior to those drops landing on the media web 14. The printhead unit 21B forms three different magnetic ink images 316, 312, and 308 on the surface of the media web 14 in the example of FIG. 3. The magnetic ink image 316 is formed first, the magnetic ink image 312 is formed second, and the magnetic ink image 308 is formed third as the media web 14 moves in the process direction P. The magnetic ink images 308, 312, and 316 can be characters, symbols, graphics, or any other arrangement of magnetic ink. The media web 14 is a porous print medium, such as uncoated paper, and in FIG. 3, the media web 14 absorbs ink 314 in the ink image 312 and ink 318 in the ink image 316.

In FIG. 3, the media web 14 passes the magnetic field generator 45, which is depicted schematically with two magnets 346 and 347. In particular, the magnetic field between the north pole of magnet 347 and the south pole of magnet 346, depicted as magnetic field lines 320 for illustrative purposes, extends in a substantially parallel direction to the surface of the media web 14. The magnetic field generator 45 applies the magnetic field to magnetic particles in the magnetic ink images 316 and 312 as the media web 14 passes the magnetic field generator 45. The magnetic particles in the images 316 and 312 align with the magnetic field. In the printer 5, the magnetic field generator 45 is separated from the printhead unit 21B by a predetermined distance, depicted as distance 332 in FIG. 3. The distance between the magnetic field generator 45 and the printhead unit 21B is sufficiently large so that the magnetic field from the magnetic field generator has substantially no effect upon the operation of the printhead unit 21B. In particular, the magnetic field does not substantially affect the movement of in-flight ink drops 304. The magnetic field generator 45 is also sufficiently close to the printhead unit 21B so that the magnetic ink on the media web 14 remains in a liquid state as printed ink images pass through the magnetic field.

Figure 5:
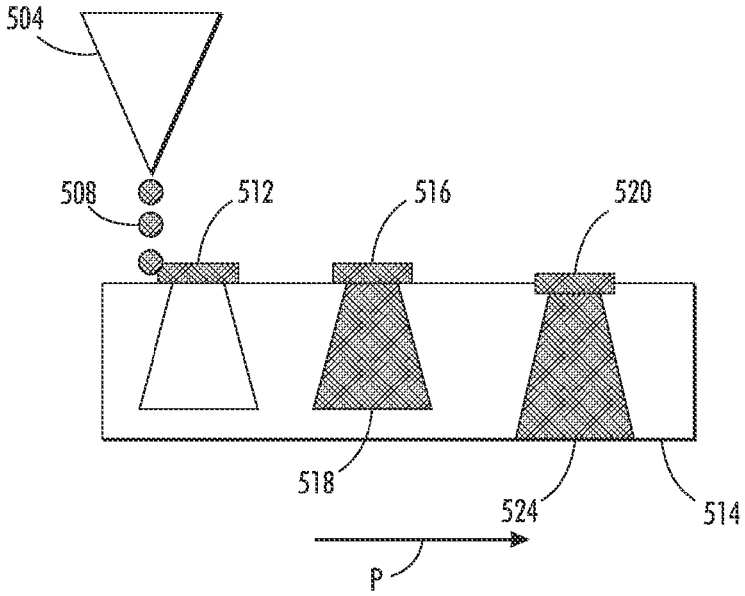
FIG. 5 PRIOR ART
FIG. 5 is a prior art diagram depicting magnetic ink printing onto a porous print medium.

The magnetic ink includes both magnetic particles and either liquid solvent or a phase-change ink in a liquid phase. In the absence of an external magnetic field, the magnetic ink includes a substantially uniform distribution of the magnetic particles formed in a suspension in the magnetic ink. The magnetic ink behaves as a magnetorheological fluid, and the application of the magnetic field increases the viscosity of the magnetic ink in directions that are perpendicular to the magnetic field, such as in direction 340 of ink absorption and bleeding into the porous media web 14. As the viscosity of the ink in the direction 340 increases, the rate of absorption of the ink into the porous media web 14 decreases. The increased viscosity generated by the magnetic field in the magnetic ink lasts for a short period of time after the print medium 14 passes through the magnetic field, which provides sufficient time for the magnetic ink images to be fixed to the print medium. Once fixed, the magnetic particles in the ink remain substantially fixed to the print medium 14. As depicted in FIG. 3, the application of the magnetic field to the magnetic ink increases the viscosity of the magnetic ink, and the media web 14 absorbs comparatively smaller volumes 314 and 318 of the magnetic ink in the ink images 312 and 316, respectively, in comparison to the prior art magnetic ink images 512, 516, and 520 depicted in FIG. 5.

Figure 4:
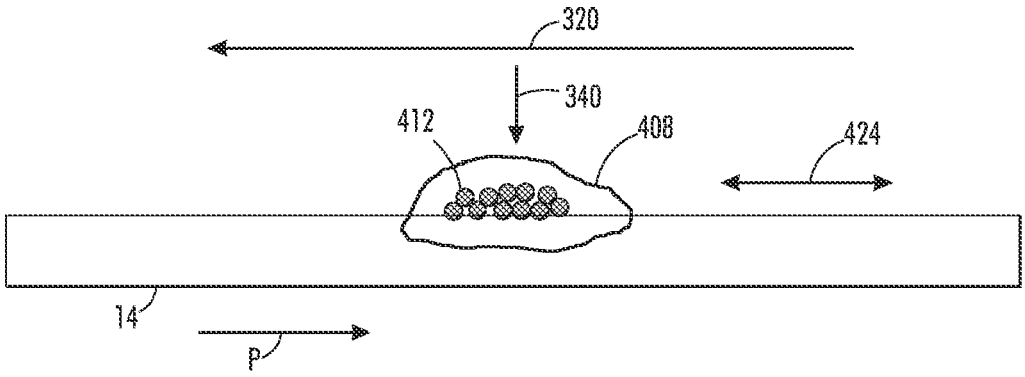
FIG. 4 is a diagram depicting magnetic particles in magnetic ink printed on a porous print medium.

FIG. 4 depicts printed magnetic ink 408 formed on the media web 14 with magnetic particles 412 suspended in the magnetic ink. In one embodiment, the particles 412 have an average size of approximately 10 nm to 500 nm in size. The arrow 320 indicates a direction of the magnetic field from the magnetic field generator 45. In FIG. 4, the magnetic particles 412 in the magnetic ink 408 are aligned in chain-like arrangements that form in parallel to the magnetic field 320. The change in anisotropic viscosity means that the magnetic ink 408 has a higher resistance to flow (i.e., a higher viscosity) in the direction 340 that is perpendicular to the magnetic field 320 and the corresponding chain-like arrangements of the magnetic particles 412. The anisotropic increase in viscosity enables the magnetic ink 408 to have a lower resistance to flow in directions that are parallel to the magnetic field 320 and magnetic particles 412, such as along the axis 424. Thus, during a printing process in the printer 5, the magnetic field generator 45 generates an anisotropic increase in the viscosity of the magnetic ink that increases the viscosity of the ink in the direction 340 as the ink absorbs into the media web 14, but enables the ink 408 to spread across the surface of the media web 14 along the axis 424 to form a printed image.

Referring again to FIG. 1, following the print zone 20 along the media path, the media web 14 moves over guide rollers 26 to one or more "mid-heaters" 30. A mid-heater 30 can use contact, radiant, conductive, and/or convective heat to control a temperature of the media. In an embodiment where the magnetic ink is a solvent-based ink, the mid-heater 30 accelerates the evaporation of the solvent in the magnetic ink to dry the magnetic ink on the surface of the media web 14. In an embodiment where the magnetic ink is a phase-change ink, the mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat and/or apply pressure to the media to fix the images to the media. The fixing assembly includes any suitable device or apparatus for fixing images to the media including heated or unheated pressure rollers, radiant heaters, heat lamps, and the like. In the embodiment of FIG. 1, the fixing assembly includes a "spreader" 40, which applies a predetermined pressure, and in some implementations, heat, to the media. The function of the spreader 40 is to take what are essentially droplets, strings of droplets, or lines of ink on web 14 and smear them out by pressure and, in some systems, heat, so that spaces between adjacent drops are filled and image solids become uniform. In addition to spreading the ink, the spreader 40 also improves image permanence by increasing ink layer cohesion and/or increasing the ink-web adhesion. The spreader 40 includes rollers, such as image-side roller 42 and pressure roller 44, to apply heat and pressure to the media. Either roller can include heat elements, such as heating elements 46, to bring the web 14 to a temperature in a range from about 35° C. to about 80° C. In alternative embodiments, the fixing assembly can be configured to spread the ink using non-contact heating (without pressure) of the media after the print zone. Such a non-contact fixing assembly uses any suitable type of heater to heat the media to a desired temperature, such as a radiant heater, UV heating lamps, and the like.

In one practical embodiment, the roller temperature in spreader 40 is maintained at an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi/side. Lower nip pressure gives less line spread while higher pressure may reduce pressure roller life.

The spreader 40 also includes a cleaning/oiling station 48 associated with image-side roller 42. The station 48 cleans and/or applies a layer of some release agent or other material to the roller surface. The release agent material can be an amino silicone oil having viscosity of about 10-200 centipoises. Only small amounts of oil are required and the oil carried by the media is only about 1-10 mg per A4 size page. In one embodiment, the mid-heater 30 and spreader 40 can be combined into a single unit, with their respective functions occurring relative to the same portion of media simultaneously. In another embodiment the media is maintained at a high temperature as it is printed to enable spreading of the ink.

Following passage through the media path, the printed media can be wound onto a roller for removal from the system. A rewind unit 90 winds the printed media web onto a takeup roller for removal from the printer 5 and subsequent processing. Alternatively, the media can be directed to other processing stations that perform tasks such as cutting, binding, collating, and/or stapling the media or the like.

Operation and control of the various subsystems, components and functions of the printer 5 are performed with the aid of the controller 50. The controller 50 can be implemented with general or specialized programmable processors that execute programmed instructions. The instructions and data required to perform the programmed functions are stored in memory associated with the processors or controllers. The processors, their memories, and interface circuitry configure the controllers and/or print engine to perform the functions described above. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Figure 2:
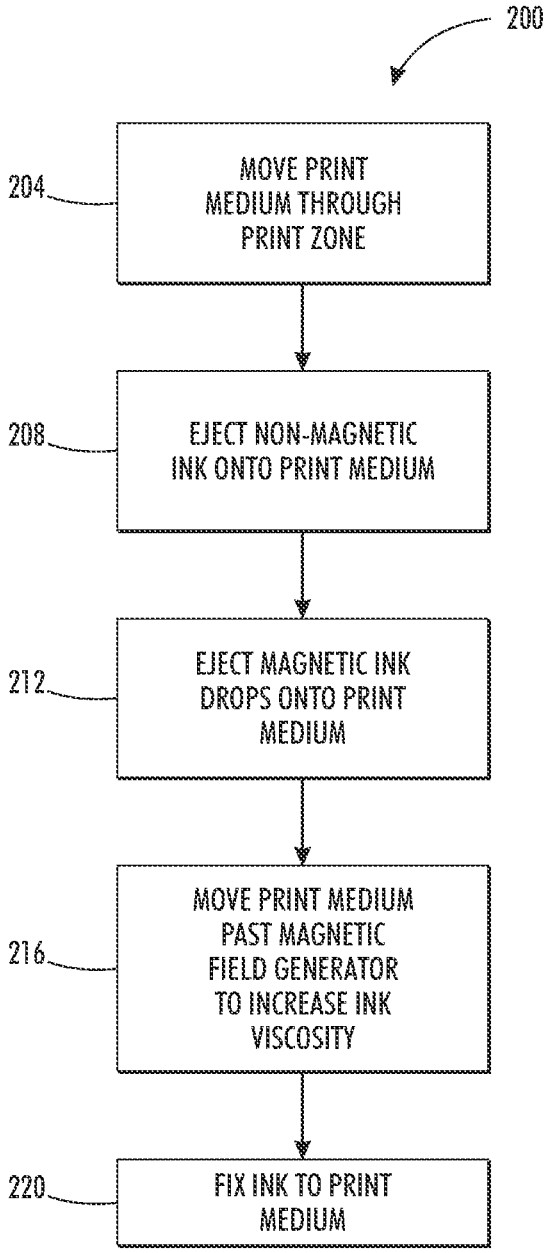
FIG. 2 is a block diagram of a process for printing magnetic ink images.

FIG. 2 depicts a process 200 for operating a printer to form magnetic ink images on a print medium. In the discussion below, a reference to the process 200 performing a function or action refers to a controller executing programmed instructions stored in a memory to operate one or more components of the printer to perform the function or action. The process 200 is described in conjunction with the printer 5 of FIG. 1 for illustrative purposes. While process 200 is described with reference to the continuous media printer 5, other printing devices, including cut-sheet media printers, can be configured to include a magnetic field generator that is suitable for use with the process 200.

In process 200, a printer moves a print medium through a print zone (block 204). In the printer 5, the print medium is the elongated media web 14 and the printer 5 moves the media web 14 in the process direction P through the print zone 20. As the print medium moves through the print zone, the printer optionally forms ink images on the print medium with a non-magnetic ink (block 208). In the printer 5, the printhead unit 21A includes a plurality of printheads that optionally form images on the media web 14 using non-magnetic inks. While the printer 5 is configured to print non-magnetic ink prior to printing the magnetic ink, an alternative printer configuration prints magnetic ink after printing the non-magnetic ink, or prints both magnetic and non-magnetic inks substantially simultaneously.

During process 200, the printer ejects magnetic ink drops onto the print medium to form magnetic ink images (block 212). The printer 5 moves the media web 14 through the print zone 20 in the process direction P past the printhead unit 21B. The controller 50 generates a plurality of firing signal to eject drops of the magnetic ink onto the media web 14 with the inkjets in the printhead unit 21B to form magnetic ink images. In one embodiment, the printhead unit 21B includes arrays of printheads that form magnetic ink images with a resolution of 600 dots per ink (DPI) on the media web 14. The controller 50 is configured to generate the firing signals with reference to digital image data to form a wide range of characters, symbols, and graphics using the magnetic ink. Examples of magnetic ink images include numerals and symbols corresponding to routing and account numbers that are formed in checks used in the banking and financial industry. For example, the printer 5 prints numbers and symbols associated with checks using the E-13B or CMC-7 font standards. The printer 5 can also eject magnetic ink drops to form a wide range of text, graphics, and symbols on the media web 14. As described above, the printer 5 also optionally ejects drops of non-magnetic ink onto the media web 14 with the printhead unit 21A. The printer 5 can form composite ink images including both non-magnetic ink and magnetic ink.

Process 200 applies a magnetic field to the print medium and the printed magnetic ink images (block 216). In the printer 5, the print medium 14 exits the print zone 20 and continues past the magnetic field generator 45. As described above, the magnetic field generator 45 can be either a permanent magnet or an electromagnet. In either embodiment, the magnetic particles in the magnetic ink formed on the media web 14 align with the magnetic field as the media web 14 passes the magnetic field generator 45.

Process 200 continues as the magnetic ink is fixed to the print medium after application of the magnetic field (block 220). A solvent-based magnetic ink fixes to the print medium as the ink dries. During the drying process, the solvent in the magnetic ink evaporates from the media web 14. In the printer 5, the mid-heater assembly 30 applies heat to the media web 14 to accelerate the drying process before the media web 14 enters the rewind unit 90. When the magnetic ink is a phase-change ink, the printed web conditioner 80 and the spreader 40 fix the magnetic phase-change ink to the media web 14.

As described above, magnetic field generator 45 increases the anisotropic viscosity of the magnetic ink in the perpendicular direction to the magnetic field, which reduces or eliminates bleeding of the magnetic ink image into the substrate and tends to align the magnetic particles. Consequently, the magnetic particles remain near the surface of the media web 14 after the printer 5 fixes the magnetic ink to the media web 14, producing magnetic ink characters and other markings having improved readability with automated devices even when printer 5 forms the magnetic ink image on a porous print medium.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art, which are also intended to be encompassed by the following claims.

What is claimed is:

1. A method of operating an inkjet printer comprising:

moving a print medium through a print zone in a process direction;

ejecting a plurality of drops of a magnetic ink from a plurality of inkjet_ nozzles in the print zone onto a surface of the print medium;

moving the print medium past an electromagnet located in the process direction from the plurality of inkjet nozzles in the print zone;

applying a magnetic field with an orientation that is substantially parallel to the process direction to the plurality of drops of the magnetic ink on the surface of the print medium with the electromagnet to increase a viscosity of the magnetic ink on the print medium in a direction that is perpendicular to the process direction extending into the print medium;

activating the electromagnet with a controller prior to moving the print medium past the electromagnet; and deactivating the electromagnet with the controller after applying the magnetic field to the plurality of drops of the magnetic ink on the surface of the print medium.

2. The method of claim 1, the print medium being a porous print medium.

3. The method of claim 2, the porous print medium being paper.

4. The method of claim 2, the paper being an uncoated paper.

5. The method of claim 1 further comprising:

fixing the magnetic ink to the print medium after the magnetic field is applied to the magnetic ink on the print medium.

6. The method of claim 1, the application of the magnetic field to the print medium further comprising:

applying the magnetic field with the electromagnet facing the surface of the print medium onto which the plurality of drops of the magnetic ink were ejected.

7. A printing apparatus comprising:

a media path configured to move a print medium through a print zone in a in a process direction;

a plurality of inkjet nozzles in the print zone configured to eject a plurality of drops of a magnetic ink onto a surface of the print medium;

an electromagnet located in the process direction from the plurality of inkjet nozzles in print zone and configured to apply a magnetic field with an orientation that is substantially parallel to the process direction to the plurality of drops of the magnetic ink on the surface of the print medium to increase a viscosity of the magnetic ink in a direction that is perpendicular to the process direction extending into the print medium; and a controller operatively connected to the electromagnet, the controller being configured to:

activate the electromagnet with the controller prior to the print medium moving past the electromagnet; and deactivate the electromagnet with the controller after the plurality of drops of the magnetic ink on the surface of the print medium move past the electromagnet.

8. The printing apparatus of claim 7, the print medium being a porous print medium.

9. The printing apparatus of claim 8, the porous print medium being paper.

10. The printing apparatus of claim 9, the paper being an uncoated paper.

11. The printing apparatus of claim 7 further comprising:

a heater located in the process direction from the electromagnet and configured to generate heat to fix the magnetic ink to the print medium after the magnetic field is applied to the magnetic ink on the print medium.

12. The printing apparatus of claim 11 further comprising:

a spreader located in the process direction from the heater and configured to apply pressure to the magnetic ink and the print medium to fix the magnetic ink to the print medium.

13. The printing apparatus of claim 7, the electromagnet being located in the process direction from the plurality of inkjets in the print zone at a distance that prevents the magnetic field from having a substantial effect on the magnetic ink in the print zone.

14. The printing apparatus of claim 7, the electromagnet being located on a side of the print medium facing the surface of the print medium with the plurality of drops of the magnetic ink.

* * * * *